US008587198B2

(12) United States Patent
Shin et al.

(10) Patent No.: US 8,587,198 B2
(45) Date of Patent: Nov. 19, 2013

(54) REAR PANEL FOR A DISPLAY DEVICE AND DISPLAY DEVICE INCLUDING THE SAME

(75) Inventors: Dong Il Shin, Uiwang-si (KR); Chang Won Park, Uiwang-si (KR); Ryun Min Heo, Uiwang-si (KR); Kuninori Okamoto, Uiwang-si (KR); Min Su Park, Uiwang-si (KR); Won Hee Lee, Uiwang-si (KR)

(73) Assignee: Cheil Industries, Inc., Gumi-si, Kyeongsangbuk-do (KR)

( * ) Notice: Subject to any disclaimer, the term of this patent is extended or adjusted under 35 U.S.C. 154(b) by 126 days.

(21) Appl. No.: 13/242,187

(22) Filed: Sep. 23, 2011

(65) Prior Publication Data

US 2012/0223637 A1 Sep. 6, 2012

(30) Foreign Application Priority Data

Mar. 3, 2011 (KR) ..... 10-2011-0018946

(51) Int. Cl.
*H01J 17/49* (2012.01)

(52) U.S. Cl.
USPC ..... 313/583; 313/582; 313/585

(58) Field of Classification Search
USPC ..... 313/582–587
See application file for complete search history.

(56) References Cited

U.S. PATENT DOCUMENTS

| | | | | |
|---|---|---|---|---|
| 6,541,913 | B1 * | 4/2003 | Mori et al. | 313/582 |
| 2001/0024921 | A1 * | 9/2001 | Hirano | 445/24 |
| 2004/0000870 | A1 * | 1/2004 | Kifune et al. | 313/582 |
| 2009/0153051 | A1 * | 6/2009 | Hwang et al. | 313/584 |
| 2013/0015762 | A1 * | 1/2013 | Fukui et al. | 313/582 |

* cited by examiner

*Primary Examiner* — Anne Hines
*Assistant Examiner* — Jose M Diaz
(74) *Attorney, Agent, or Firm* — Lee & Morse, P.C.

(57) ABSTRACT

A rear panel for a plasma display panel (PDP) includes a substrate, and an address electrode on the substrate, the address electrode including an aluminum containing layer and a silver containing layer stacked on each other.

20 Claims, 5 Drawing Sheets

FIG. 5

TABLE 1

| | Examples | | | | | | Comparative examples | | |
|---|---|---|---|---|---|---|---|---|---|
| | 1 | 2 | 3 | 4 | 5 | 6 | 1 | 2 | 3 |
| Line width of main electrode (μm) | 98 | 100 | 103 | 100 | 99 | 105 | 103 | 86 | 96 |
| Line width of terminal (μm) | 50 | 54 | 52 | 54 | 54 | 55 | 62 | 48 | 51 |
| Thickness of electrode (μm) | 10 | 12 | 10 | 9 | 15 | 13 | 10 | 3 | 8 |
| Thickness ratio | 1:9 | 1:2.3 | 1:1 | 1:2.3 | 1:1.5 | 1:1.5 | Single layer (Al) | Single layer (Ag) | Single layer (Ag+Al) |
| Linear resistance (Ω) | 13 | 15 | 15 | 13 | 14 | 17 | 50 | 6 | $1\times10^6$ |
| Gas leakage | X | X | X | X | X | X | O | X | O |
| Adhesiveness | Good | Good | Good | Good | Good | Good | Failure | Good | Failure |
| Edge curling (μm) | 0.5 | 0.1 | 0.1 | 0 | 0 | 0 | 0 | 2 | 0 |
| Line resolution (μm) | 30 | 30 | 30 | 30 | 30 | 30 | 60 | 30 | 80 |

REAR PANEL FOR A DISPLAY DEVICE AND DISPLAY DEVICE INCLUDING THE SAME

BACKGROUND

1. Field

Example embodiments relate to a rear panel for a display device and to a display device including the same. More particularly, example embodiments relate to a rear panel with an address electrode including a double layer formed by stacking an aluminum containing layer and a silver containing layer to prevent gas leakage, a surface crack or detachment, and an increase in resistance, thereby securing reliability.

2. Description of the Related Art

A display device, e.g., a plasma display panel (PDP), may include front and rear substrates facing each other with a plurality of electrodes therebetween. For example, a rear panel of the PDP may include a plurality of address electrodes on the rear substrate, and a front panel of the PDP may include a plurality of display electrodes on the front substrate. Application of voltage to the display and address electrodes triggers emission of light from a phosphorescent material therebetween.

SUMMARY

Embodiments are directed to a rear panel of a PDP and to a PDP including the same, which substantially overcome one or more of the problems due to the limitations and disadvantages of the related art.

An aspect of the example embodiments provides a rear panel for a PDP, including a substrate, and an address electrode on the substrate, the address electrode including an aluminum containing layer and a silver containing layer stacked on each other.

The silver containing layer may be stacked on the aluminum containing layer, the aluminum containing layer being between the substrate and the silver containing layer.

The aluminum containing layer may be stacked on the silver containing layer, the silver containing layer being between the substrate and the aluminum containing layer.

A portion of each of the aluminum containing layer and the silver containing layer may contact the substrate.

The aluminum containing layer and the silver containing layer may extend along a same direction and partially overlap each other.

The aluminum containing layer may include a first part and a second part adjacent to each other in a longitudinal direction of the address electrode, the silver containing layer may include a third part and a fourth part adjacent to each other in the longitudinal direction of the address electrode; and the second part of the aluminum containing layer and the third part of the silver containing layer may be stacked on top of each other to define a double layer.

The second part of the aluminum containing layer may be between the substrate and the third part of the silver containing.

The third part of the silver containing layer may be between the substrate and the second part of the aluminum containing layer.

The double layer may have a length of about 3 mm or more, as measured from a distal end of the aluminum containing layer adjoining the silver containing layer along the longitudinal direction of the address electrode.

The double layer may have a thickness of about 5 μm to about 20 μm, as measured from the substrate along a normal thereto.

The silver containing layer and the aluminum containing layer may have a thickness ratio of about 1:0.1 to about 1:9.

The aluminum containing layer and the silver containing layer may extend along a same direction and partially overlap each other.

The aluminum containing layer may overlap at least two different surfaces of the silver containing layer.

The aluminum containing layer and the silver containing layer may be separate layers.

A portion of the address electrode including stacked aluminum containing layer and silver containing layer may have a predetermined length and a predetermined thickness, the predetermined length being at least 150 times larger than the predetermined thickness.

An aspect of the example embodiments also provides a PDP, including a rear substrate facing a front substrate, and a plurality of address electrodes between the front and rear substrates, each address electrode including an aluminum containing layer and a silver containing layer stacked on each other.

The silver containing layer of each address electrode may be connected to a tape carrier package (TCP) on the rear substrate.

BRIEF DESCRIPTION OF THE DRAWINGS

The above and other features and advantages will become more apparent to those of ordinary skill in the art by describing in detail exemplary embodiments with reference to the attached drawings, in which:

FIG. 5 illustrates a table of experimental results.

DETAILED DESCRIPTION

Figure 1:
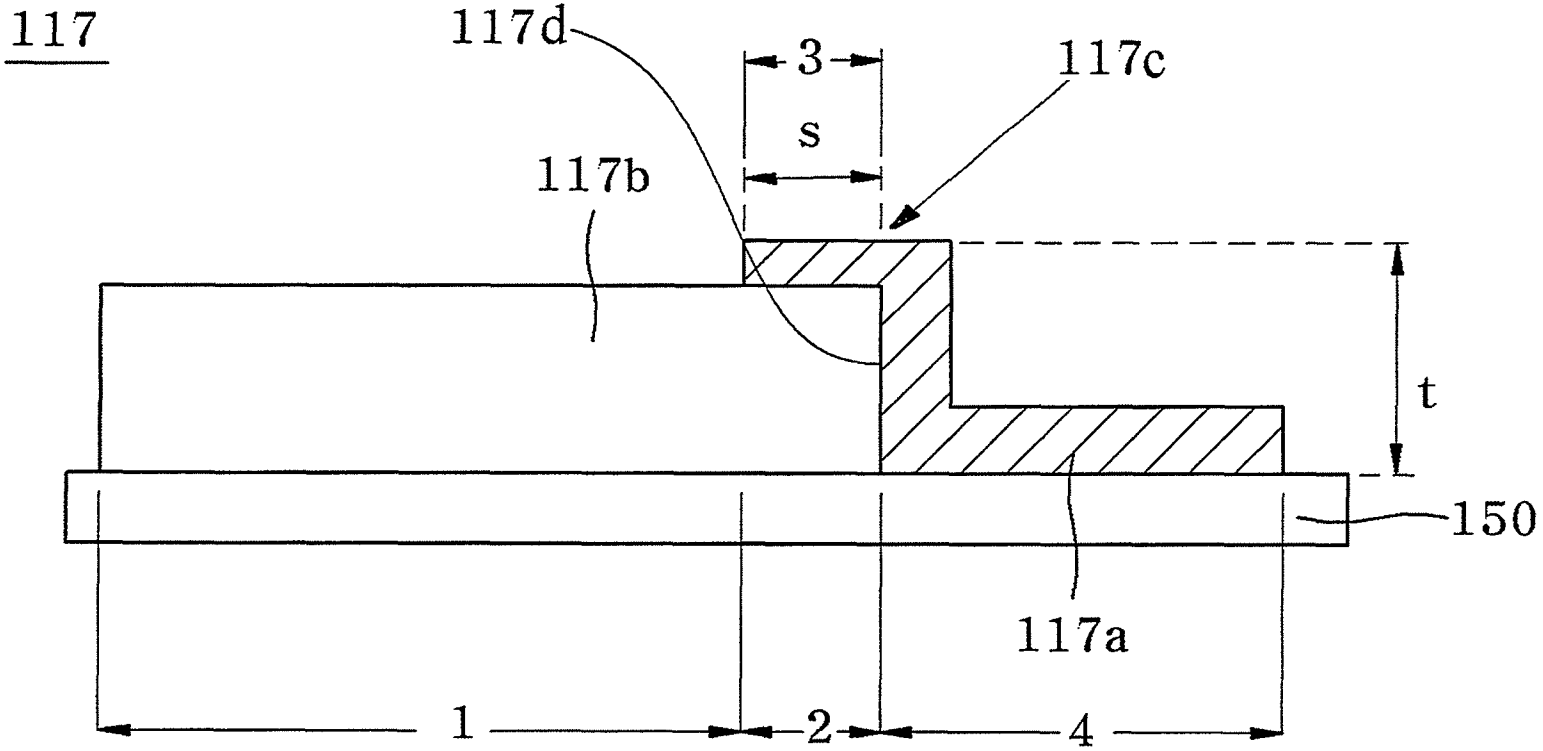
FIG. 1 illustrates a cross-sectional view of a rear panel of a display device according to one exemplary embodiment.

Korean Patent Application No. 10-2011-0018946, filed on Mar. 3, 2011, in the Korean Intellectual Property Office, and entitled: "Rear Substrate For Plasma Display Panel and Plasma Display Panel Comprising the Same," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Like reference numerals refer to like elements throughout.

One aspect of an embodiment provides a rear panel for a display device, e.g., a PDP, and an address electrode formed on a rear substrate of the rear panel. The address electrode may include a double layer of stacked aluminum containing layer and silver containing layer.

The double layer may be formed by stacking the silver containing layer on the aluminum containing layer. Alternatively, the double layer may be formed by stacking the aluminum containing layer on the silver containing layer.

Herein, the "aluminum containing layer" and the "silver containing layer" refer to conductive layers formed of electrode paste compositions including aluminum and silver as conductive powder, respectively, e.g., may include sufficient aluminum or silver powder to be conductive. For example, a majority of the silver containing layer may be silver powder, e.g., the silver containing layer may consist essentially of silver powder. Similarly, a majority of the aluminum containing layer may be aluminum powder, e.g., the aluminum containing layer may consist essentially of aluminum powder.

The rear substrate may be any suitable substrate used for a rear panel of a PDP, e.g., a glass substrate.

The address electrode may include the silver containing layer and the aluminum containing layer at a thickness ratio of about 1:0.1 to about 1:9. For example, a thickness of the aluminum containing layer may be equal to or larger than a thickness of the silver containing layer, e.g., the thickness of the silver containing layer to the aluminum containing layer may be in a ratio of about 1:1 to about 1:9. Within this range, gas leakage and resistance increase may be prevented or substantially minimized.

In the address electrode, the aluminum containing layer and the silver containing layer may adjoin the substrate. The aluminum containing layer may be divided into a first part and a second part in a longitudinal direction of the address electrode, the silver containing layer may be divided into a third part and a fourth part in the longitudinal direction of the address electrode, and the double layer may be formed by stacking the second part and the third part. Here, the double layer may be formed by stacking the third part on the second part or by stacking the second part on the third part.

The first part and the second part of the aluminum containing layer, and the third part and the fourth part of the silver containing layer may have varying lengths with respect to the length of the double layer of the address electrode. For example, the first part and the second part of the aluminum containing layer may be adjusted, such that the double layer may have a length of about 3 mm or more. Similarly, the third part and the fourth part of the silver containing layer may be adjusted, such that the double layer may have a length of about 3 mm or more.

For example, in the address electrode, the aluminum containing layer and the silver containing layer may adjoin the substrate, and the double layer may be formed of the silver containing layer partially stacked on the aluminum containing layer. Here, the double layer may have a length of about 3 mm or more, e.g., about 5 mm to about 20 mm, from a distal end of the aluminum containing layer adjoining the silver containing layer.

FIG. 1 illustrates a cross-sectional view of a rear panel for a PDP according to one exemplary embodiment.

As illustrated in FIG. 1, an address electrode 117 may be formed on a substrate 150, and may include an aluminum containing layer 117*b* and a silver containing layer 117*a*. The aluminum containing layer 117*b* and the silver containing layer 117*a* may be arranged to have a double layer 117*c* of the silver containing layer 117*a* partially stacked on the aluminum containing layer 117*b*. That is, the aluminum containing layer 117*b* may be divided into a first part 1 and a second part 2, and the silver containing layer 117*a* may be divided into a third part 3 and a fourth part 4, so the double layer 117*c* may be formed of the third part 3 stacked on the second part 2. In other words, the second part 2 of the aluminum containing layer 117*b* may be between, e.g., directly between, the substrate 150 and the third part 3 of the silver containing layer 117*b*.

In FIG. 1, a length of the double layer 117*c* is represented by s and may be about 3 mm or more, e.g., about 5 mm to about 20 mm. A thickness of the double layer 117*c* is represented by t and may be about 5 μm to about 20 μm, e.g., about 7 μm to about 15 μm. It is noted that the length s of the double layer 117*c* may be measured from a distal end 117*d* of the aluminum containing layer 117*b* adjoining the silver containing layer 117*a*. In other words, the length s may be measured from a surface interface between the aluminum containing layer 117*b* and the silver containing layer 117*a* that is substantially perpendicular to the substrate 150.

In an address electrode according to another exemplary embodiment, the aluminum containing layer and the silver containing layer may adjoin the substrate, and the double layer may be formed of the aluminum containing layer partially stacked on the silver containing layer. Here, the length of the double layer may be about 3 mm or more, e.g., about 5 mm to about 20 mm from a distal end of the aluminum containing layer adjoining the silver containing layer.

Figure 2:
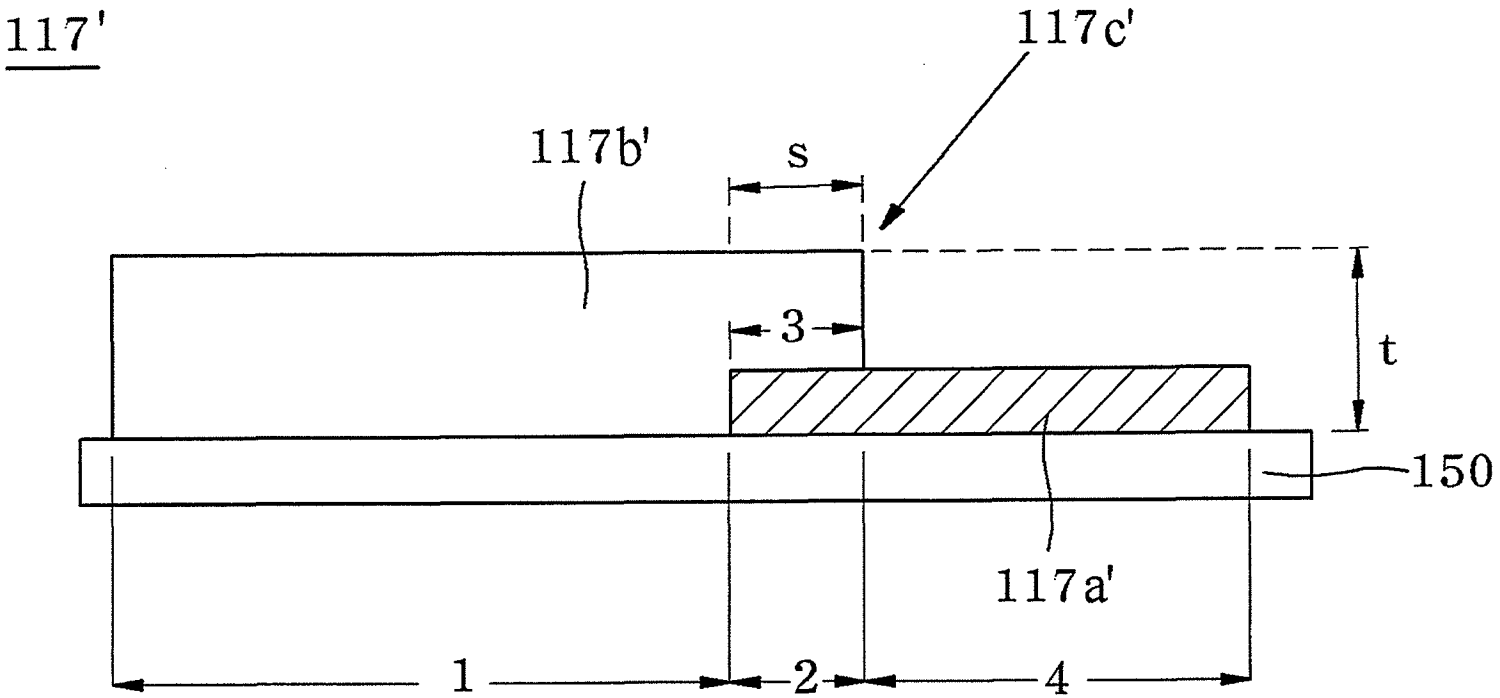
FIG. 2 illustrates a cross-sectional view of a rear panel of a display device according to another exemplary embodiment.

In detail, as illustrated in FIG. 2, an address electrode 117' may include an aluminum containing layer 117*b'*, a silver containing layer 117*a'*, and a double layer 117*c'* of the aluminum containing layer 117*b'* partially stacked on the silver containing layer 117*a'*, which are formed on the substrate 150. Here, the aluminum containing layer 117*b'* is divided into a first part 1 and a second part 2, the silver containing layer 117*a'* is divided into a third part 3 and a fourth part 4, and the double layer 117*c'* is formed of the second part 2 stacked on the third part 3. That is, the third part 3 of the silver containing layer 117*a'* may be between, e.g., directly between, the substrate 150 and the second part 2 of the aluminum containing layer 117*b'*.

In FIG. 2, the length s of the double layer 117*c'* may be about 3 mm or more, e.g., about 5 mm to about 20 mm. Further, the thickness t of the double layer 117*c'* may be about 5 μm to about 20 μm, e.g., about 7 μm to about 15 μm. When the length s and thickness t are in the above range, gas leakage and resistance increase may be prevented or substantially minimized.

Figure 3:
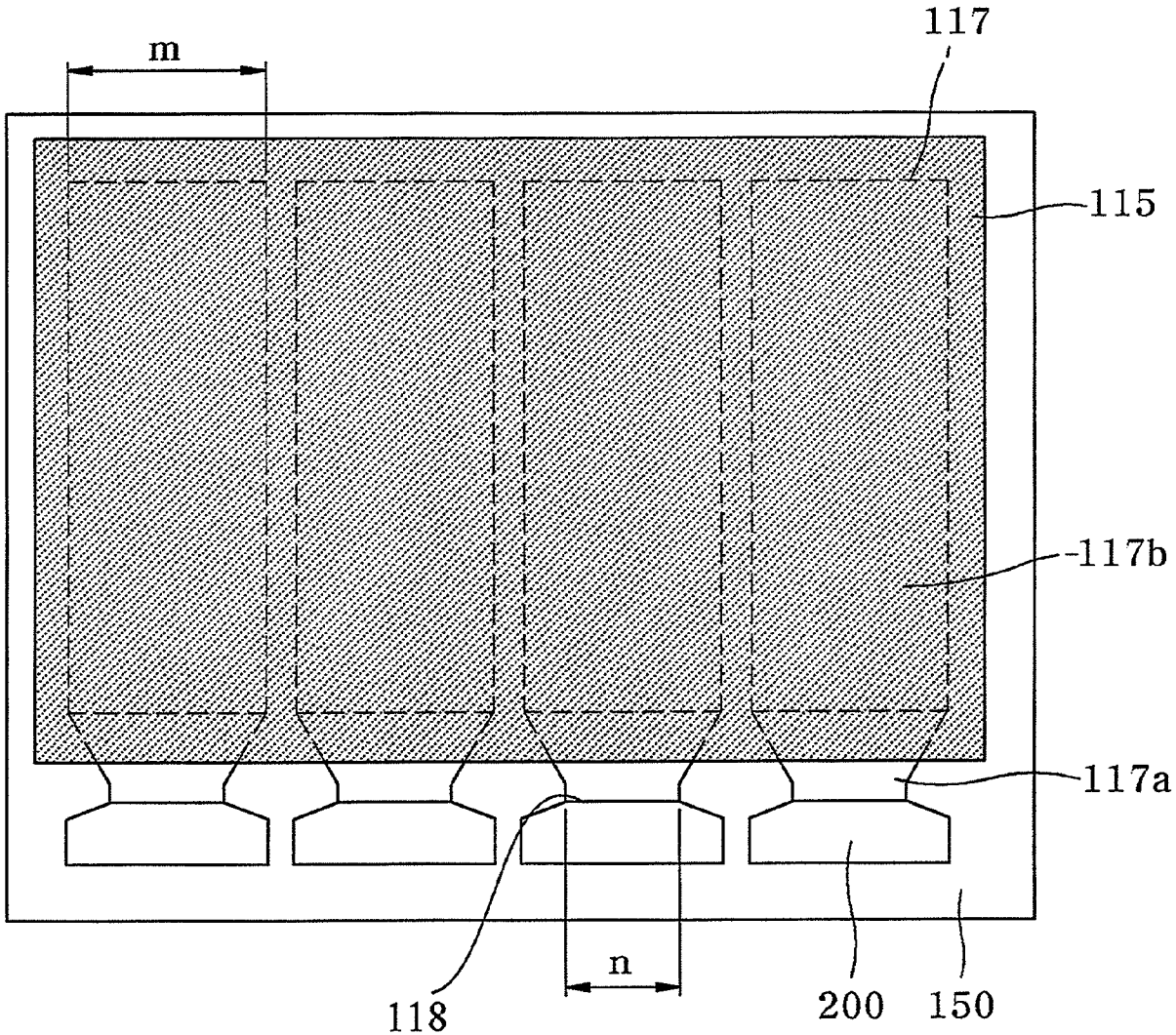
FIG. 3 illustrates a plan view of a rear panel of a display device according to exemplary embodiments.

FIG. 3 illustrates a plan view of the address electrode 117 on the substrate 150. Referring to FIG. 3, the address electrode 117 including the aluminum containing layer 117*b* and the silver containing layer 117*a* may be disposed on the substrate 150. It is noted that while FIG. 3 illustrates the address electrode 117 described previously with reference to FIG. 1, a structure including the address electrode 117' described with reference to FIG. 2 is within the scope of the example embodiments.

A dielectric layer 115 may be formed on the substrate 150 to cover the address electrode 117. The silver containing layer 117*a* may be connected to a tape carrier package (TCP) 200. In FIG. 3, m represents a line width of the address electrode 117, and n represents a line width of an electrode terminal 118.

The aluminum containing layer 117*b* and the silver containing layer 117*a* may be formed of any suitable electrode paste composition. The electrode paste composition may include conductive powder, a binder resin, a glass frit, a photo-polymerizable compound, an initiator, and a solvent.

The aluminum containing layer 117*b* may include an electrode paste composition including about 30 wt % to about 70 wt % of aluminum as conductive powder, and the silver containing layer 117*a* may include an electrode paste composition including about 30 wt % to about 60 wt % of silver as conductive powder. Further, in addition to aluminum or silver, the electrode paste compositions may further include any suitable conductive particles, e.g., one or more of gold (Au), palladium (Pd), platinum (Pt), copper (Cu), chrome (Cr), cobalt (Co), tin (Sn), lead (Pb), zinc (Zn), iron (Fe), iridium (Ir), osmium (Os), rhodium (Rh), tungsten (W), molybdenum (Mo), and nickel (Ni).

The conductive powder may be in any suitable shape, e.g., at least one of spherical, needle, plate, and amorphous shape. The aluminum may have an average particle diameter ($D_{50}$) of about 2 μm to about 20 μm, and the silver may have an average particle diameter ($D_{50}$) of about 0.5 μm to about 2.5 μm.

The binder resin may include copolymers obtained by copolymerization of a carboxyl group containing monomer, e.g., (meth)acrylic acid and itaconic acid, and a monomer having an ethylene unsaturated double bond, e.g., acrylic acid ester (methyl acrylate, methyl methacrylate, etc.), styrene, acryl amide, and acrylonitrile, cellulose, and water-soluble cellulose derivatives, without being limited thereto. These binder resins may be used alone or as a mixture of two or more thereof. The binder resin may be present in an amount of about 1 wt % to about 20 wt % in the electrode paste composition, based on a total weight of the electrode paste composition.

Examples of the glass frit may include $SiO_2$, $B_2O_3$, $Bi_2O_3$, $Al_2O_3$, ZnO, $Na_2O$, $K_2O$, $Li_2O$, BaO, CaO, MgO, SrO, PbO, and/or $TiO_2$, e.g., the glass frit may include at least one of $Bi_2O_3$, $B_2O_3$, $SiO_2$, and $Al_2O_3$. The glass frit may be present in an amount of about 1 wt % to about 30 wt % in the electrode paste composition, based on a total weight of the electrode paste composition.

The photo-polymerizable compound may be a multifunctional monomer or oligomer used for a photosensitive resin composition, e.g., at least one of trimethylolpropane triacrylate, ethylene glycol diacrylate, triethylene glycol diacrylate, 1,4-butanediol diacrylate, 1,6-hexanediol diacrylate, neopentyl glycol diacrylate, pentaerythritol diacrylate, pentaerythritol triacrylate, dipentaerythritol diacrylate, dipentaerythritol triacrylate, dipentaerythritol pentaacrylate, dipentaerythritol hexaacrylate, bisphenol A diacrylate, novolac epoxy acrylate, ethylene glycol dimethacrylate, diethylene glycol dimethacrylate, triethylene glycol dimethacrylate, propylene glycol dimethacrylate, 1,4-butanediol dimethacrylate, and 1,6-hexanediol dimethacrylate, and the like. The photo-polymerizable compound may be present in an amount of about 1 wt % to about 10 wt % in the electrode paste composition, based on a total weight of the electrode paste composition.

The initiator may be a compound which is photoreactive in a wavelength range of about 200 nm to about 500 nm, e.g., at least one of benzophenone, acetophenone, and triazine compounds, e.g., 2-benzyl-2-(dimethylamino)-1-[4-(4-morpholinyl)phenyl]-1-butanone. The initiator may be present in an amount of about 0.1 wt % to about 10 wt % in the electrode paste composition, based on a total weight of the electrode paste composition.

The solvent may include any suitable solvent, e.g., esters, aliphatic alcohols, a carbitol solvent, a cellosolve solvent, a hydrogen solvent, or the like. Examples of the solvent may include, e.g., at least one of 2,2,4-trimethyl-1,3-pentanediol monoisobutyrate, methyl cellosolve, ethyl cellosolve, butyl cellosolve, aliphatic alcohols, terpineol, ethylene glycol, ethylene glycol monobutyl ether, butyl cellosolve acetate, texanol, butyl carbitol acetate and the like, and combinations thereof. The solvent may constitute the remainder of the electrode paste composition.

The address electrode of the example embodiments may be manufactured by any suitable electrode forming method. For example, the method may include: (a) printing and drying an aluminum containing electrode paste composition while a screen mask (Screen mask 1) is placed on a glass substrate; and (b) printing, drying, exposing, developing, and firing a silver containing electrode paste composition while another screen mask (Screen mask 2) is placed on the glass substrate. Stage (a) may further include exposing, developing, and firing processes after printing and drying. It is further noted that an original thickness, i.e., a thickness a layer is deposited to on the glass substrate, may be reduced after drying and firing.

Alternatively, the method may include: (a) printing and drying a silver containing electrode paste composition while a screen mask (Screen mask 3) is placed on a glass substrate; and (b) printing, drying, exposing, developing, and firing an aluminum containing electrode paste composition while another screen mask (Screen mask 4) is placed on the glass substrate. Stage (a) may further include exposing, developing, and firing processes after printing and drying.

The screen masks 1 and 4 may screen a terminal portion of the address electrode, and the screen masks 2 and 3 may screen a main electrode portion of the address electrode.

In printing, the electrode paste composition may be deposited to a thickness of about 5 μm to about 40 μm on the glass substrate. In drying, the deposited composition may be dried at about 80° C. to about 150° C. for about 5 minutes to about 30 minutes. Exposing may be performed by irradiating UV at about 5 mW to about 20 mW, about 100 mJ to about 300 mJ. Developing serves to eliminate an exposed or unexposed portion and may be performed, e.g., using an aqueous $Na_2CO_3$ solution at about 20° C. to about 30° C. In firing, the remaining composition may be treated at about 500° C. to about 600° C. for about 20 minutes to about 40 minutes.

A PDP according to the example embodiments may include a rear substrate and a front substrate which are disposed to face each other, a plurality of address electrodes according to example embodiments on the rear substrate, a first dielectric layer formed on the rear substrate and covering the address electrodes, a plurality of walls adjoining the first dielectric layer and forming a discharge space, a fluorescent layer formed in the discharge space, a plurality of bus electrodes disposed on a lower surface of the front substrate in a direction to cross the address electrodes, and a second dielectric layer covering the bus electrodes. The PDP will be described in more detail with reference to FIG. 4

Figure 4:
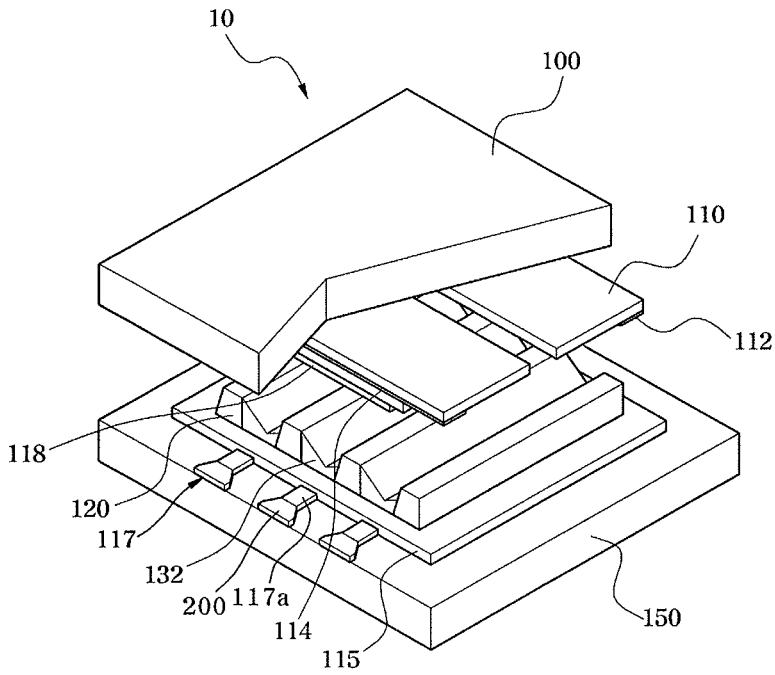
FIG. 4 illustrates a perspective view of a PDP according to exemplary embodiments.

Referring to FIG. 4, a PDP 10 may include the rear substrate 150 and a front substrate 100. A plurality of the address electrodes 117 may be formed between the rear substrate 150 and the front substrate 100 according to example embodiments.

In detail, as illustrated in FIG. 4, the address electrodes 117 may be formed in a longitudinal direction on the rear substrate 150, and a first dielectric layer 115 may be formed on the rear substrate 150 to cover the address electrodes 117. A plurality of walls 120, i.e., barriers, may be formed on the first dielectric layer 115 to define a discharge space, and a phosphorescent layer 132, e.g., a fluorescent layer, including phosphorescent materials corresponding to red, green, and blue (RGB) may be formed in the discharge space to define a pixel region.

The front substrate 100 may be disposed to face the rear substrate 150. A plurality of bus electrodes 112 may be formed on a lower surface of the front substrate 100 to face the discharge space. The bus electrodes 112 may be disposed in a horizontal direction to cross the address electrodes 117. A transparent electrode 110 may be installed between the front substrate 100 and the bus electrodes 112, and the bus electrodes 112 may be formed on the transparent electrode 110. A second dielectric layer 114, which stores charges generated in the panel and covers the bus electrodes 112, may be formed on the transparent electrode 110. A MgO layer 118, which protects the second dielectric layer 114 and facilitates electron emission, may be formed on the transparent electrode 110.

The address electrodes in FIG. 4 may have the structure of the address electrodes 117, 117' described previously with reference to FIG. 1 or 2. The silver containing layer 117*a*, which is a portion of the address electrodes 117, may be connected to the TCP 200 of the rear substrate 150.

Inert gas, e.g., Ne, Ar, Xe, Ne+Ar, Ne+Xe, or the like, may be introduced into a space between the rear substrate 150 and the front substrate 100, and accordingly light is generated by electric discharge when a threshold voltage or more is applied to the electrodes.

EXAMPLES

The following Examples and Comparative Examples are provided in order to set forth particular details of one or more embodiments. However, it will be understood that the embodiments are not limited to the particular details described. Further, the Comparative Examples are set forth to highlight certain characteristics of certain embodiments, and are not to be construed as either limiting the scope of the invention as exemplified in the Examples or as necessarily being outside the scope of the invention in every respect.

Examples 1 to 6 and Comparative Examples 1 to 3 were performed. Details regarding components used to form the electrodes in the examples are as follows.

1. Aluminum powder: spherical type ($D_{50}$=7 μm)
2. Silver powder: spherical type ($D_{50}$=1.2 μm)
3. Binder resin: Poly(methyl methacrylate-CO-methacrylic acid) solution (Solid resin: 40 wt %, CCTech Co., Ltd.)
4. Photo-polymerizable compound: Trimethylolpropane ethoxy triacrylate (Photonics Co., Ltd.)
5. Glass frit: Bismuth glass frit ($Bi_2O_3$—$B_2O_3$—$SiO_2$—$Al_2O_3$, Particlogy Co., Ltd.)
6. Initiator: 2-benzyl-2-(dimethylamino)-1-[4-(4-morpholinyl)phenyl]-1-butanone (CIBA Specialty Chemicals Corp.)
7. Solvent: 2,2,4-trimethyl-1,3-pentanediol monoisobutyrate

Preparation Example 1

Preparation of Aluminum Containing Electrode Paste Composition 18 wt % of a binder resin solution, 6 wt % of a photo-polymerizable compound, and 3 wt % of an initiator were stirred into 18 wt % of a solvent at 40° C. for 4 hours. 35 wt % of aluminum powder and 20 wt % of glass fit were added to the mixture, and milled and dispersed, thereby preparing a paste.

Preparation Example 2

Preparation of Silver Containing Electrode Paste Composition 12 wt % of a binder resin solution, 8.5 wt % of a photo-polymerizable compound, and 1.5 wt % of an initiator were stirred into 24 wt % of a solvent at 40° C. for 4 hours. 50 wt % of silver powder and 4 wt % of glass fit were added to the mixture, and milled and dispersed, thereby preparing a paste.

Preparation Example 3

Preparation of Silver and Aluminum Containing Electrode Paste Composition

A silver electrode paste and aluminum electrode paste were prepared in the same manners as in Preparation Examples 1 and 2. The pastes were mixed at a weight ratio of 1:1 and dispersed, thereby preparing a paste.

Example 1

On a glass substrate with a screen mask placed thereon, the paste prepared in Preparation Example 1 was printed to a thickness of 13 μm and dried at 110° C. for 20 minutes. The dried composition was exposed at 14 mW and 200 mJ and developed using a 0.4% $Na_2CO_3$ aqueous solution at 30° C. The product was dried and fired at 580° C. for 30 minutes, thereby forming an aluminum containing layer. On the glass substrate with another screen mask laid thereon, the paste prepared in Preparation Example 2 was printed to a thickness of 16 μm, such that a portion of the paste prepared in Preparation Example 2 overlapped a portion of the paste prepared in Preparation Example 1, followed by drying at 110° C. for 20 minutes. The dried composition was exposed at 14 mW and 200 mJ and developed using a 0.4% aqueous $Na_2CO_3$ solution at 30° C. The product was dried and fired at 580° C. for 30 minutes to form a silver containing layer on the aluminum containing layer, thereby preparing the address electrode of FIG. 1. The double layer in which the silver containing layer was stacked on the aluminum containing layer had a length of 5 mm and a thickness of 10 μm.

Example 2

The address electrode was prepared in the same manner as in Example 1 except that the aluminum containing layer was was not fired after development.

Example 3

The address electrode was prepared in the same manner as in Example 1 except that the aluminum containing layer was was not exposed, developed and fired after drying.

Example 4

The paste prepared in Preparation Examples 1 and 2 were printed, dried, exposed, developed, and fired on a glass substrate in the same manner as in Example 1, with the exception that the paste prepared in Preparation Example 2 was formed first on the glass substrate to form a silver containing layer. As such, the paste prepared in Preparation Example 1 was formed on the glass substrate to overlap a portion of the silver containing layer, thereby forming the address electrode of FIG. 2. The double layer in which the aluminum containing layer is stacked on the silver containing layer had a length of 5 mm and a thickness of 9 μm Example 5

The address electrode was prepared in the same manner as in Example 4 except that the aluminum containing layer was was not fired after development.

Example 6

The address electrode was prepared in the same manner as in Example 4 except that the aluminum containing layer was was not exposed, developed and fired after drying.

Comparative Example 1

The paste prepared in Preparation Example 1 was printed, dried, exposed, developed, and fired in the same manner as in Example 1, without using a screen mask, thereby forming a single-layered aluminum electrode.

Comparative Example 2

The paste prepared in Preparation Example 2 was printed, dried, exposed, developed, and fired in the same manner as in Example 1, without using a screen mask, thereby forming a single-layered silver electrode.

Comparative Example 3

The paste prepared in Preparation Example 3 was printed, dried, exposed, developed, and fired in the same manner as in Example 1, without using a screen mask, thereby forming a single-layered electrode containing a mixture of silver and aluminum.

Experimental Example

Each of the address electrodes in Examples 1-6 and Comparative Examples 1-3 was evaluated in terms of their properties. The evaluation methods are described blow, and the results are reports in Table 1 below.

<Evaluation Method>

1. Line Widths

A line width (m) of the main electrode (address electrode) and a line width (n) of a terminal after firing were measured. The line widths were measured using an Axio scope (Karl-Zeiss) after firing each of the electrodes.

2. Thickness of Each Electrode.

The thickness of each electrode was measured using a P-10 (Tencor). In Examples 1 to 6, the thickness of the double layer of each address electrode was measured.

3. Thickness Ratio of the Silver Containing Layer and Aluminum Containing Layer

The thickness ratio was measured in each electrode after firing. In particular, a height ratio of the thicknesses on a SEM cross section was measured.

4. Linear Resistance

The linear resistance was measured using a linear resistance measuring instrument, Multimeter (Keithley).

5. Gas Leakage

A front substrate and a rear substrate, on which each of the electrodes prepared in Examples 1-6 and Comparative Examples 1-3 was mounted, were attached to each other. Then, it was evaluated whether vacuum was maintained between the front and rear substrates. In Table 1 (FIG. 5), "X" indicates no leakage, while "O" indicates gas leakage.

6. Adhesion to TCP

Each electrode was disposed as in FIG. 3, and was thermally treated with a 0.4% nitric acid solution at 40° C. for 1 hour, followed by thermal treatment with a 7% NaOH solution at 40° C. for 1 hour. Then, a 3M tape (Scotch Magic tape) was attached to the electrode and then stripped off, thereby investigating adhesiveness based on whether an electrode pattern was detached. No detachment of an electrode pattern was evaluated as "good," whereas detachment of an electrode pattern was evaluated as "failure."

7. Edge Curling

A difference between a maximum height of a distal end of each main electrode and a thickness of the middle was evaluated. The thickness of the electrode was measured using a P-10 (Tencor).

8. Line Resolution

It was evaluated whether a pattern of a terminal electrode was formed using each of 10 μm, 20 μm, 30 μm, 40 μm, 50 μm, 60 μm, 70 μm, and 80 μm photo masks. A minimum value to form a pattern was recorded.

As shown in Table 1 (see FIG. 5), the electrodes according to Examples 1 to 6 did not allow gas leakage or resistance increase. Further, the electrodes of Examples 1 to 6 exhibited excellent adhesiveness to a terminal.

In addition, as compared with the single-layered aluminum electrode in Comparative Example 1, the electrodes in Examples 1-6 exhibited a line resolution of up to 30 μm. Also, as compared with the single-layered silver electrode in Comparative Example 2, the electrodes in Examples 1-6 exhibited a very low edge curling. As further illustrated in Table 1, conventional electrodes, e.g., the electrodes in Comparative Examples 1 and 3, exhibited gas leakage, inferior adhesiveness to a terminal, and high resistance.

Therefore, according to example embodiments, an address electrode includes a double layer of aluminum and silver. That is, each address electrode includes two separate layers of aluminum and silver that contact and partially overlap each other, thereby preventing gas leakage, detachment, and increased resistance.

In contrast, an electrode containing only silver, which has a high density and may exhibit reduced gas leakage after firing, may have high costs and non-uniform resistance, thereby causing potential short circuits at the electrode terminal due to migration of silver. An electrode containing only aluminum may be damaged in a process of etching a PDP wall, may be detached or exhibit decreased durability when bonded to a TCP, and may exhibit gas leakage due to its low density and porosity.

Attempts have been made to increase density of the conventional electrode containing only aluminum. However, such electrodes exhibited increased resistance due to increased contact between aluminum particles, thereby causing increased driving voltage and making it difficult to apply the aluminum containing electrode to the PDP. Further, attempts have been made to increase glass frit content in the electrode. However, such attempts caused increased resistance, thereby causing difficulties to drive the PDP. An electrode containing a paste mixture of silver and aluminum may decrease conductivity of silver and cause a potential difference between silver and aluminum, thereby increasing resistance and reducing conductivity.

The double layer of aluminum and silver in the address electrode according to example embodiments, however, may exhibit minimized gas leakage without increased resistance. Further, an address electrode according to example embodiments is cost-efficient, and exhibits high adhesiveness and durability, as well as minimized surface crack or damage.

Although some embodiments have been disclosed herein, it should be understood by those skilled in the art that these embodiments are provided by way of illustration only, and that various modifications, changes, and alterations can be made without departing from the spirit and scope of the invention. Therefore, the scope of the invention should be limited only by the accompanying claims and equivalents thereof

What is claimed is:

1. A rear panel for a plasma display panel (PDP), comprising:

a substrate; and an address electrode on the substrate, the address electrode including an aluminum containing layer and a silver containing layer stacked on each other, wherein a portion of each of the aluminum containing layer and the silver containing layer adjoins the substrate.

2. The rear panel as claimed in claim 1, wherein the silver containing layer is partially stacked on the aluminum containing layer, the aluminum containing layer being between the substrate and the silver containing layer.

3. The rear panel as claimed in claim 1, wherein the aluminum containing layer is partially stacked on the silver containing layer, the silver containing layer being between the substrate and the aluminum containing layer.

4. A rear panel for a plasma display panel (PDP), comprising:

a substrate; and an address electrode on the substrate, the address electrode including an aluminum containing layer and a silver containing layer stacked on each other, wherein a portion of each of the aluminum containing layer and the silver containing layer contacts the substrate.

5. The rear panel as claimed in claim 4, wherein the aluminum containing layer and the silver containing layer extend along a same direction and partially overlap each other.

6. The rear panel as claimed in claim 4, wherein:

the aluminum containing layer includes a first part and a second part adjacent each other in a longitudinal direction of the address electrode;

the silver containing layer includes a third part and a fourth part adjacent each other in the longitudinal direction of the address electrode; and the second part of the aluminum containing layer and the third part of the silver containing layer are stacked on top of each other to define a double layer.

7. The rear panel as claimed in claim 6, wherein the second part of the aluminum containing layer is between the substrate and the third part of the silver containing.

8. The rear panel as claimed in claim 6, wherein the third part of the silver containing layer is between the substrate and the second part of the aluminum containing layer.

9. The rear panel as claimed in claim 6, wherein the double layer has a length of about 3 mm or more, as measured from a distal end of the aluminum containing layer adjoining the silver containing layer along the longitudinal direction of the address electrode.

10. The rear panel as claimed in claim 6, wherein the double layer has a thickness of about 5 μm to about 20 μm, as measured from the substrate along a normal thereto.

11. The rear panel as claimed in claim 1, wherein the silver containing layer and the aluminum containing layer have a thickness ratio of about 1:0.1 to about 1:9.

12. The rear panel as claimed in claim 1, wherein the aluminum containing layer and the silver containing layer extend along a same direction and partially overlap each other.

13. The rear panel as claimed in claim 1, wherein the aluminum containing layer overlaps at least two different surfaces of the silver containing layer.

14. The rear panel as claimed in claim 1, wherein the aluminum containing layer and the silver containing layer are separate layers.

15. The rear panel as claimed in claim 1, wherein a portion of the address electrode including the stacked aluminum containing layer and silver containing layer has a predetermined length and a predetermined thickness, the predetermined length being at least 150 times larger than the predetermined thickness.

16. A plasma display panel (PDP), comprising:

a rear substrate facing a front substrate; and a plurality of address electrodes between the front and rear substrates, each address electrode including an aluminum containing layer and a silver containing layer stacked on each other, wherein a portion of each of the aluminum containing layer and the silver containing layer adjoins the rear substrate.

17. The PDP as claimed in claim 16, wherein the silver containing layer of each address electrode is connected to a tape carrier package (TCP) on the rear substrate.

18. The PDP as claimed in claim 16, wherein the silver containing layer is partially stacked on the aluminum containing layer, the aluminum containing layer being between the rear substrate and the silver containing layer.

19. The PDP as claimed in claim 16, wherein the aluminum containing layer is partially stacked on the silver containing layer, the silver containing layer being between the rear substrate and the aluminum containing layer.

20. The PDP as claimed in claim 16, wherein the aluminum containing layer overlaps at least two different surfaces of the silver containing layer.

* * * * *